US009351612B2

(12) United States Patent
Wei

(10) Patent No.: US 9,351,612 B2
(45) Date of Patent: May 31, 2016

(54) SHOWER DOOR ASSEMBLY FOR FAST ASSEMBLY AND ADJUSTMENT

(71) Applicant: Ideal Sanitary Ware Co., Ltd, Guangdong (CN)

(72) Inventor: Wuxiang Wei, Guangdong (CN)

(73) Assignee: IDEAL SANITARY WARE CO. LTD., Guangdong (CN)

( * ) Notice: Subject to any disclaimer, the term of this patent is extended or adjusted under 35 U.S.C. 154(b) by 95 days.

(21) Appl. No.: 14/264,524

(22) Filed: Apr. 29, 2014

(65) Prior Publication Data

US 2015/0272397 A1 Oct. 1, 2015

(30) Foreign Application Priority Data

Apr. 1, 2014 (CN) ..... 2014 1 0127978

(51) Int. Cl.

| | |
|---|---|
| ***A47K 3/00*** | (2006.01) |
| ***A47K 3/34*** | (2006.01) |
| ***A47K 3/36*** | (2006.01) |
| ***E05D 11/00*** | (2006.01) |
| ***E05D 7/081*** | (2006.01) |
| *A47K 3/30* | (2006.01) |

(52) U.S. Cl.

CPC ... *A47K 3/34* (2013.01); *A47K 3/00* (2013.01); *A47K 3/36* (2013.01); *E05D 7/081* (2013.01); *E05D 11/0054* (2013.01); *A47K 2003/307* (2013.01); *E05Y 2201/11* (2013.01); *E05Y 2600/12* (2013.01); *E05Y 2600/14* (2013.01); *E05Y 2600/312* (2013.01); *E05Y 2600/324* (2013.01); *E05Y 2600/502* (2013.01); *E05Y 2600/522* (2013.01); *E05Y 2600/56* (2013.01); *E05Y 2600/62* (2013.01); *E05Y 2900/132* (2013.01)

(58) Field of Classification Search

CPC ..... A47K 3/284
USPC ..... 4/596–614
See application file for complete search history.

*Primary Examiner* — Lori Baker
(74) *Attorney, Agent, or Firm* — Pearne & Gordon LLP

(57) ABSTRACT

A shower door assembly with at least one adjustment assembly has an adjustment device and a locking device. The locking device includes a blocking element, a pressing element and an elastic element between the blocking element and the pressing element. The elastic element is arc-shaped when unlocked. An inclined surface projects to the blocking element. The curvature of the elastic element is thus reduced until it engages with the adjustment device. A driving device includes a cam mechanism and a sliding element having one end in contact with the pressing element and the other end sliding along with the inclined surface when driven by the cam mechanism so as to push the pressing element toward the blocking element, and thus reduce the curvature of the arc-shaped elastic element until the elastic element is engaged with the adjustment device.

10 Claims, 11 Drawing Sheets

SHOWER DOOR ASSEMBLY FOR FAST ASSEMBLY AND ADJUSTMENT

FIELD OF THE INVENTION

The present invention relates to shower door assembly, and in particular, to adjustment assembly used therein which achieves fast assembling and adjustment.

BACKGROUND OF THE INVENTION

Doors used for shower enclosure are often mounted against wall surfaces and the doors thus mounted are kept as vertical as possible. However, the wall surfaces of buildings are often not exactly vertical, for example, titled toward outside/inside by an angle. Therefore, if mounted completely along the wall surface, the doors may not be smoothly opened or closed. In this regard, it is necessary to adjust the distances between the top/bottom end of a door and a wall surface so as to keep the door in a vertical position.

To achieve this adjustment, a door assembly usually comprises a stationary frame to be attached to a wall surface, and a movable frame connected with a door panel, such as a glass door panel. The stationary frame is firstly attached to the wall surface and then the movable frame is moved toward the stationary frame, during which the distances between the top and bottom ends of the movable frame, and the stationary frame are such adjusted that the movable frame is in a vertical position, and thus so is the door panel. The stationary and movable frames are finally connected to each other by drilling thereon and by using fasteners.

However, in one aspect, the drilling operation requires at least two people to cooperate and is very time-consuming. In another aspect, the drilling may inadvertently cause damages to the surfaces of the frames generally made of aluminum materials, which is undesirable to consumers.

SUMMARY OF THE INVENTION

An object of the present invention is to provide a shower door assembly which comprises a stationary frame, a movable frame and at least one adjustment assembly disposed between the stationary frame and the movable frame, the at least one adjustment assembly comprising an adjustment device and a locking device, the adjustment device being detachably connected to the stationary frame and having an extension, the locking device being detachably connected to the movable frame and comprising two opposite sides and a bottom side connecting said two opposite sides, the opposite sides and the bottom side defining a first cavity having a first depth and a second cavity having a second smaller depth, the first and second cavity jointly receiving the extension of the adjustment device;

a blocking element, a pressing element and an elastic element disposed between the blocking element and the pressing element being located in the first cavity, the elastic element being arc-shaped when unlocked, an interface between the first and the second cavity having at least a portion forming an inclined surface projecting to the blocking element; and a driving device comprising a cam mechanism and a sliding element in the first cavity, the sliding element has one end in contact with the pressing element and the other end sliding along with the inclined surface when driven by the cam mechanism so as to push the pressing element toward the blocking element, and thus reduce the curvature of the arc-shaped elastic element until the elastic element is engaged with the adjustment device.

Preferably, the arc-shaped elastic element has an intrados facing towards the blocking element.

In one embodiment, the blocking element comprises a guiding rod. The pressing element and the arc-shaped each has a through hole, respectively, through which the guiding rod can pass so as to guide the movements of the pressing element and the elastic element within the first cavity.

In one embodiment, the pressing element has a guiding groove for receiving the one end of the sliding element. The guiding groove has a width large enough to maintain the one end within the guiding groove when the sliding element is sliding along the inclined surface.

In one embodiment, the locking device has a threaded hole penetrating through one of the two opposite sides such that when the locking device and the adjustment device are engaged, the engagement can be enhanced by screwing a screw into the threaded hole. Preferably, in this embodiment, a spacer element is disposed within the second cavity in a gap formed by the extension of the adjustment device. The spacer element is provided to prevent deformation of the elastic element already flattened, which may be caused by excessive force applied by the screwing as mentioned above.

In one embodiment, the pressing element has platforms at two sides, for in contact with the two opposite sides of the locking device, so as to prevent turnover of the pressing element during movement.

In one embodiment, the locking device has a receiving groove at one of the two opposite sides for receiving the cam mechanism.

In one embodiment, a surface of the extension of the adjustment device that is in contact with the arc-shaped elastic element is provided with teeth, such that the elastic element will be imbedded between two adjacent teeth when the elastic element is pressed, so as to enhance the engagement of the adjustment device and the locking device.

In one embodiment, the locking device is attached to the movable frame at at least two different linkage points, such that the locking device will not rotate about the movable frame.

In one embodiment, the arc-shaped elastic element is flattened when pressed, i.e., the curvature is zero.

In one embodiment, the stationary frame has two sidewalls, each received within respective slot provided with the locking device.

In one embodiment, the shower door assembly comprises two adjustment assemblies located at terminal ends of the stationary/movable frames, and the adjustment assemblies are disposed in opposite.

In one embodiment, the arc-shaped elastic element is constituted by a single metal sheet or a plurality of metal sheets that are disposed side by side. The single metal sheet, or the plurality of metal sheets as a whole, has a thickness between about 0.1 mm and no more than 0.2 mm, preferably 0.15 mm.

The shower door assembly provided by the present invention transfers the rotation of the cam mechanism to the translational movement of the pressing element by the inclined surface and the sliding element. The movement of the pressing element towards the blocking element makes the arc-shaped elastic element disposed there between flattened, such that the lateral width of the elastic element increases, causing engagement with the extension of the adjustment device. Therefore, the adjustment device is locked by the locking device and thus immovable, the relative position between the stationary frame and the movable frame is thus fixed. When the cam mechanism is counter-rotated, the arc-shaped elastic element will disengage with the adjustment device due to the restoring force of the elastic element and return to unlocked state. The adjustment device can achieve fast assembling and adjustment of the shower door and, in the meantime, is able to lock and release by minimum force.

Elements that are irrelevant of the spirit of the invention is omitted from the drawings for clarity purpose.

DETAILED DESCRIPTION

The invention will now be described in more detail in reference to preferable examples in conjugation with the accompanied drawings.

Figure 1:
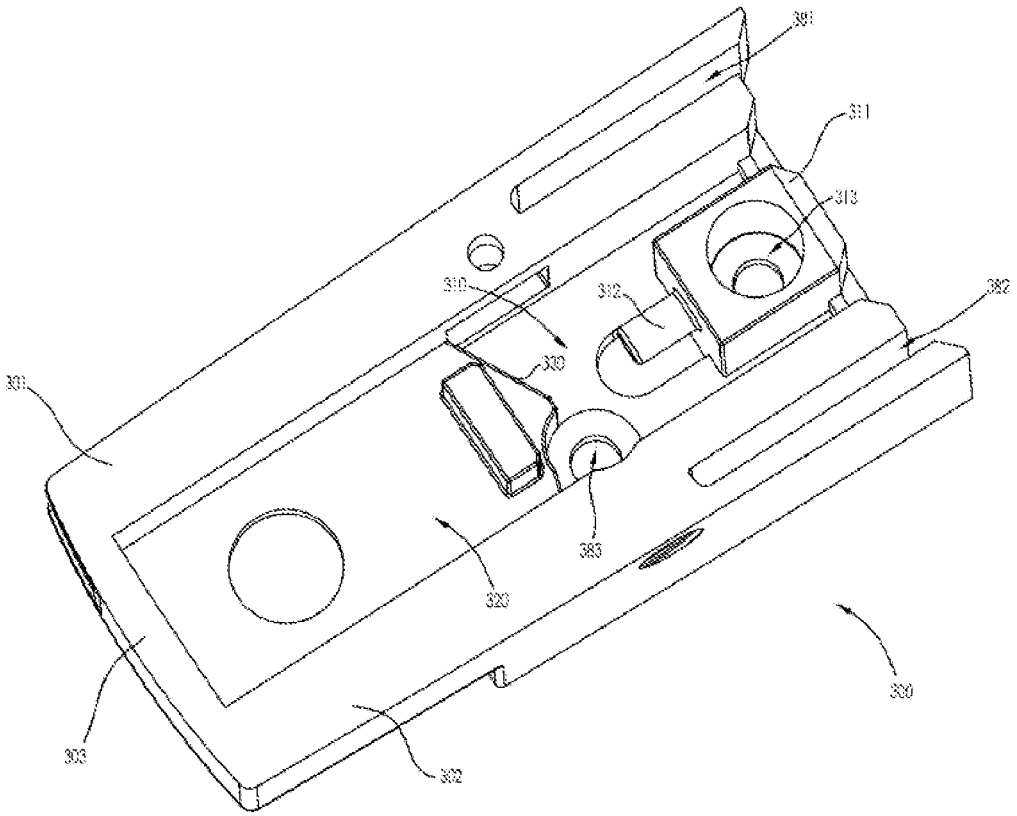
FIG. 1 schematically and partially shows a locking device according to one embodiment of the invention.

FIG. 1 partially shows a locking device 300 according to one embodiment of the invention. The locking device 300 is substantially rectangular in shape. Two opposite sides 301, 302 and a bottom side 303 jointly define an open internal space. The internal space comprises a first cavity 310 and a second cavity 320. The second cavity 320 has a less depth than that of the first cavity 310. An interface between the first and second cavities 310, 320 has at least a part forming an inclined surface 330 projecting toward the first cavity 310.

The locking device 300 is coupled to a movable frame 200 (see FIG. 9) at at least two linkage points 313, 383, such that the locking device 300 will not rotate around the movable frame 200.

In FIG. 1, a blocking element 311 is provided within the first cavity 310 at an end that is away from the bottom side 303. In this example, the blocking element 311 has a guiding rod 312 for guiding the movements of other elements in the first cavity 31.

Figure 2:
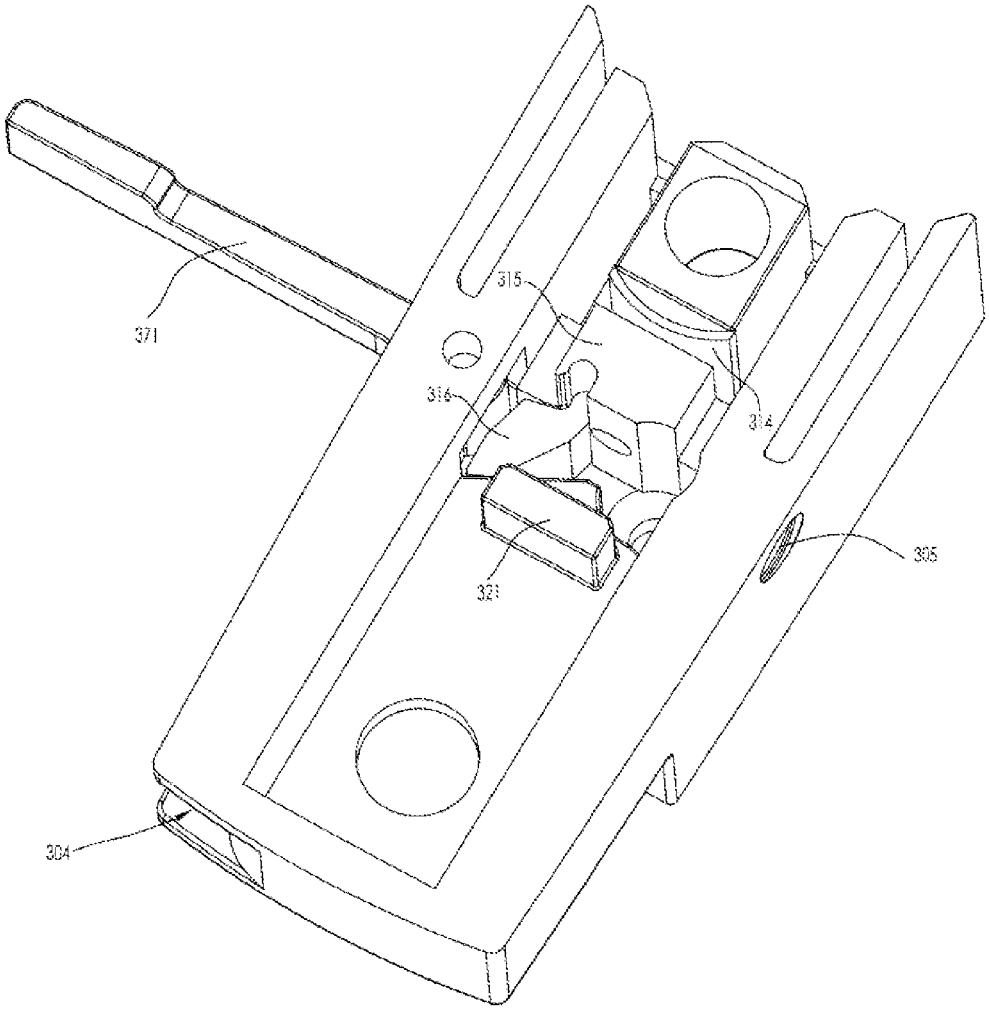
FIG. 2 shows the locking device of FIG. 1 from another perspective of view, showing more elements.

FIG. 2 shows more elements of the locking device 300. In the first cavity 310 is disposed a pressing element 315, and an arc-shaped elastic element 314 between the pressing element 315 and the foresaid blocking element 311. The arc-shaped elastic element 314 has an intrados facing toward the blocking element 311. The pressing element 315 is able to be moved within the first cavity 310 in relation to the blocking element 311 so as to press or release from the elastic element 314 to change the curvature, and in turn the lateral width, of the elastic element 314.

A sliding element 316 is further provided in the first cavity 310 and has one end in contact with the pressing element 315, and the other end in contact with and sliding along the inclined surface 330. Therefore, when actuated by the cam mechanism 317, the sliding element 316 will slide along the inclined surface and push the pressing element to move toward the blocking element 311. The locking device 300 has a groove 304 at its one side for receiving the cam mechanism 317. FIG. 2 shows only a handle 371 of the cam mechanism 317.

Figure 3:
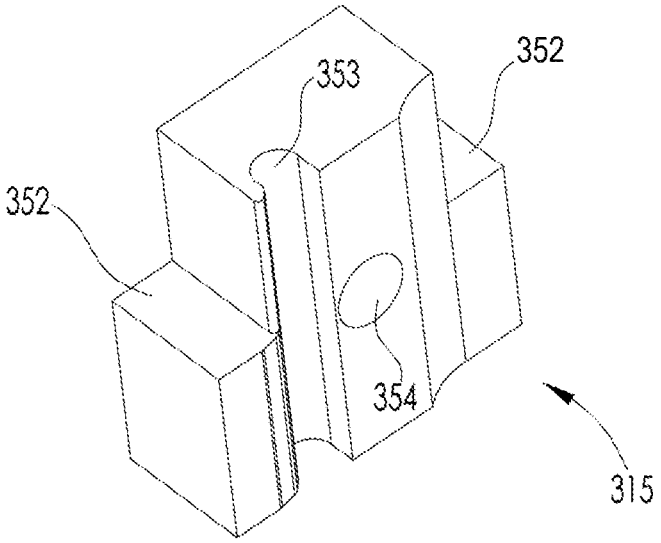
FIG. 3 is an exemplary pressing element of the invention.
Figure 4:
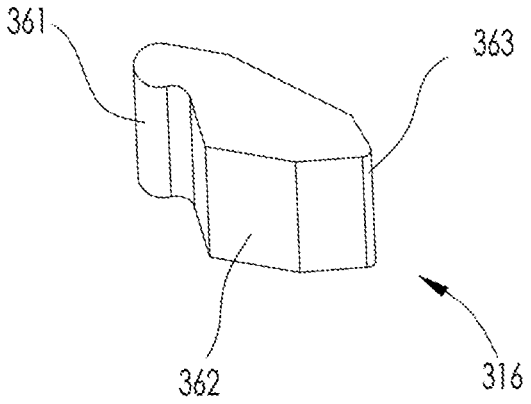
FIG. 4 is an exemplary sliding element of the invention.

FIGS. 3 and 4 show an exemplary pressing element 315 and a sliding element 316, respectively. The pressing element 315 comprises a sliding groove 353 for receiving the one end 361 of the sliding element 316. The sliding groove 353 is wide enough such that the end 361 is always maintained therein during the slide of the sliding element 316 along the inclined surface 330. The pressing element 315 has two platforms 352 at two sides for contacting the two opposite sides 301, 302 of the locking device 300, so as to prevent from overturn of the pressing element 315 during its movement. In this example, the pressing element 315 is provided with a through hole 354, through which the guiding rod 312 of the blocking element 311 can pass, so as to guide the movement of the pressing element 315.

The sliding element 316 comprises the one end 361 received within the sliding groove 353, a contact surface 362 in contact with the cam mechanism 317, and the other end 363 in contact with and sliding along the inclined surface 330. When rotated, the cam mechanism 317 pushes, through the contact surface 362, the sliding element 316 to rotate about the end 361, and in the meantime, the other end 363 slides along the inclined surface 330. Because the inclined surface 330 is projected toward the first cavity 310, the sliding element 316 pushes the pressing element 315 to move toward the blocking element 311.

Figure 5:
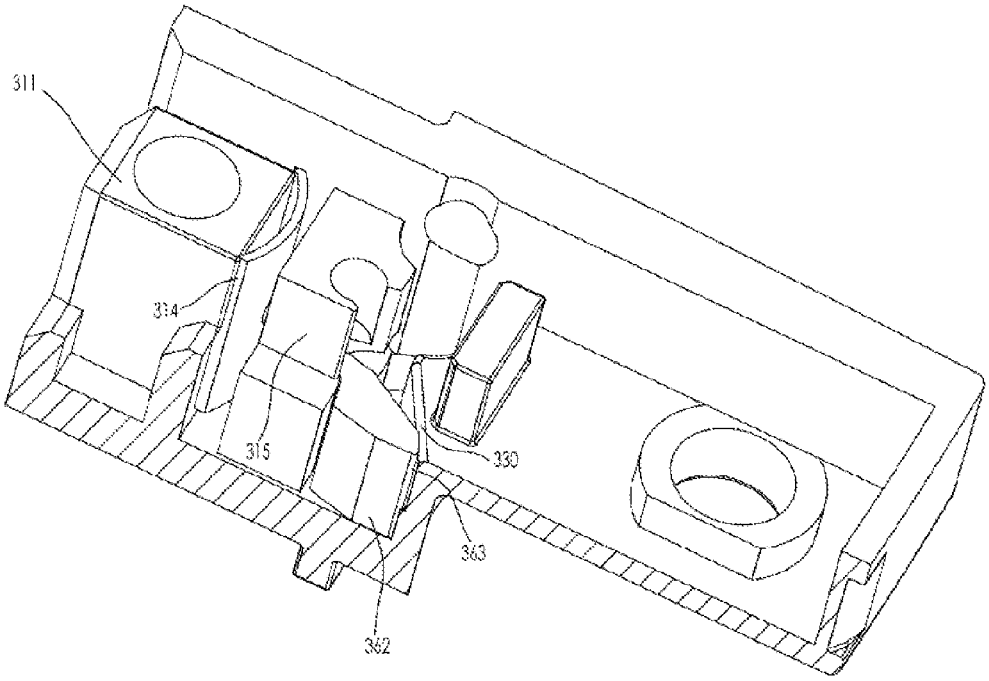
FIG. 5 shows a sectional view of an exemplary locking device.

FIG. 5 is a sectional view of the locking device, showing the relative positions of respective element in the first cavity 310 and the cooperation between them.

Figure 6:
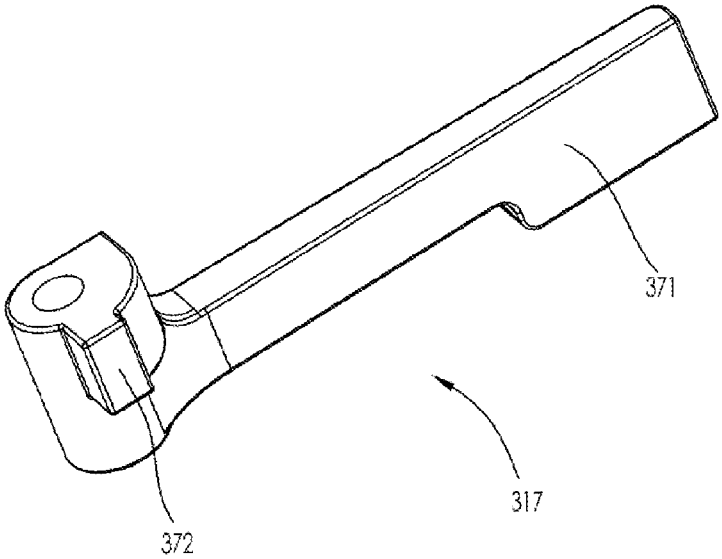
FIG. 6 shows an exemplary cam mechanism of the invention.

FIG. 6 shows an exemplary cam mechanism 317 which comprises a handle 371 and a cam portion 372. The handle 371 is provided to facilitate rotation operation of the cam mechanism and the cam portion 372 is used for contact with the contact surface 362 of the sliding element 316. The cam mechanism 317 may be attached to the side 301 by pins such that it may rotate about the side 301, such that the cam portion 372 is in contact with the contact surface 362 to push the sliding element 316 to move.

Figure 7:
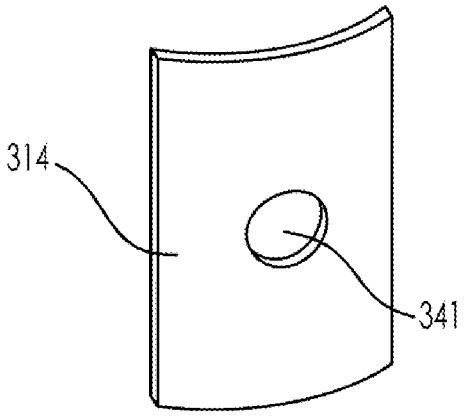
FIG. 7 shows an exemplary arc-shaped element of the invention.

FIG. 7 shows an exemplary elastic element 314 which has an intrados preferably facing toward the blocking element 311. The elastic element 314 preferably has a through hole 341 through which the guiding rod 312 can pass to guide the movement of the elastic element 314. When pressed by the pressing element 315, the curvature of the elastic element 314 will decrease, so the lateral width increases. In one example, the curvature of the elastic element 314 is reduced to zero, i.e., the lateral width reaches maximum value and the elastic element 314 is flattened. The arc-shaped element can be a single metal sheet, or a plurality of metal sheets arranged side by side, so as to provide both suitable elastic force and strength. In the example, the elastic element has a thickness of about 0.15 mm. A thickness more than 0.2 mm may not provide sufficient elastic force and less than 0.1 mm may not provide sufficient strength.

Figure 8:
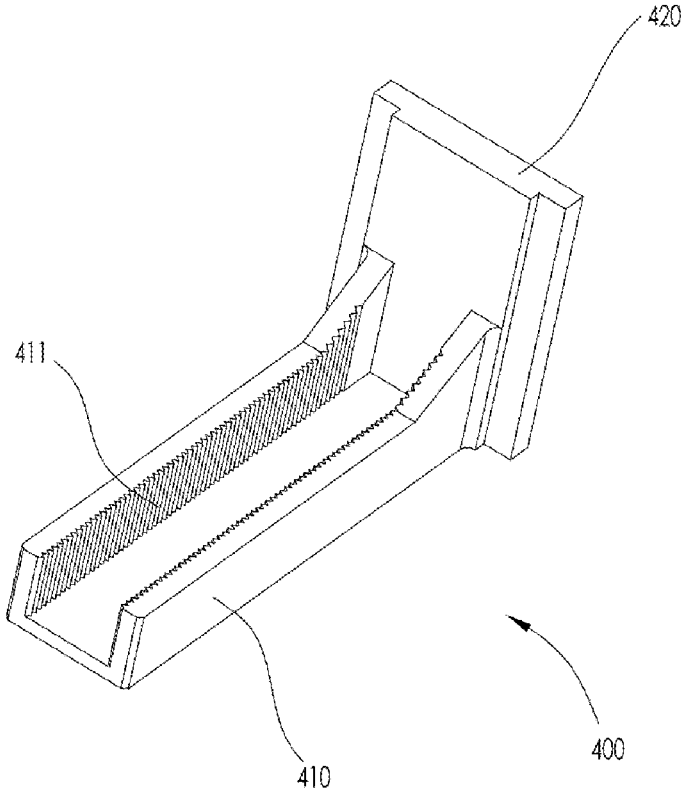
FIG. 8 shows an exemplary adjustment device of the invention.

FIG. 8 shows an exemplary adjustment device 400 comprising a securing portion 420 detachably connected to the stationary frame 100, and an extension 410. The inner surface of the extension is distributed with a plurality of teeth 411. The teeth are provided to achieve more close and reliable engagement with the locking device 300.

Figure 9:
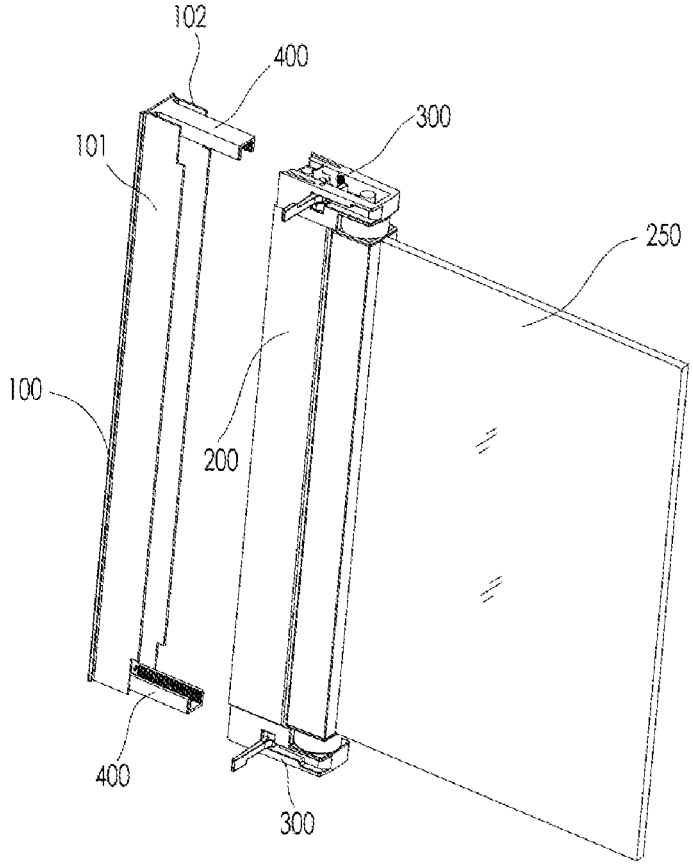
FIG. 9 is an exploded view showing a shower door assembly of the invention.

FIG. 9 schematically shows a shower door assembly of the present invention. The shower door assembly comprises a stationary frame 100, a movable frame 200, and two adjustment assemblies connected between the stationary frame 100 and the movable frame 200, with each of the two adjustment assemblies being located at respective ends of the stationary frame/movable frame. Each adjustment assembly is consisted of the locking device 300 and the adjustment device 400, the relative position and cooperation between them are shown in the figure. The movable frame 200 is coupled with a pivot door 250 which can be, for example, a glass door. The pivot door 250 may be connected to the movable frame 200 by suitable methods, for example by the locking device 300. For example, a through hole can be provided on the locking device 300, through which a pivot shaft of the pivot door can pass so as to be linked with the locking device 300.

As shown in FIG. 9, the stationary frame 100 have two sidewalls 101, 102 which, when assembling, may be inserted into respective slot 381, 382 (see FIG. 1) of the locking device 300.

Figure 10:
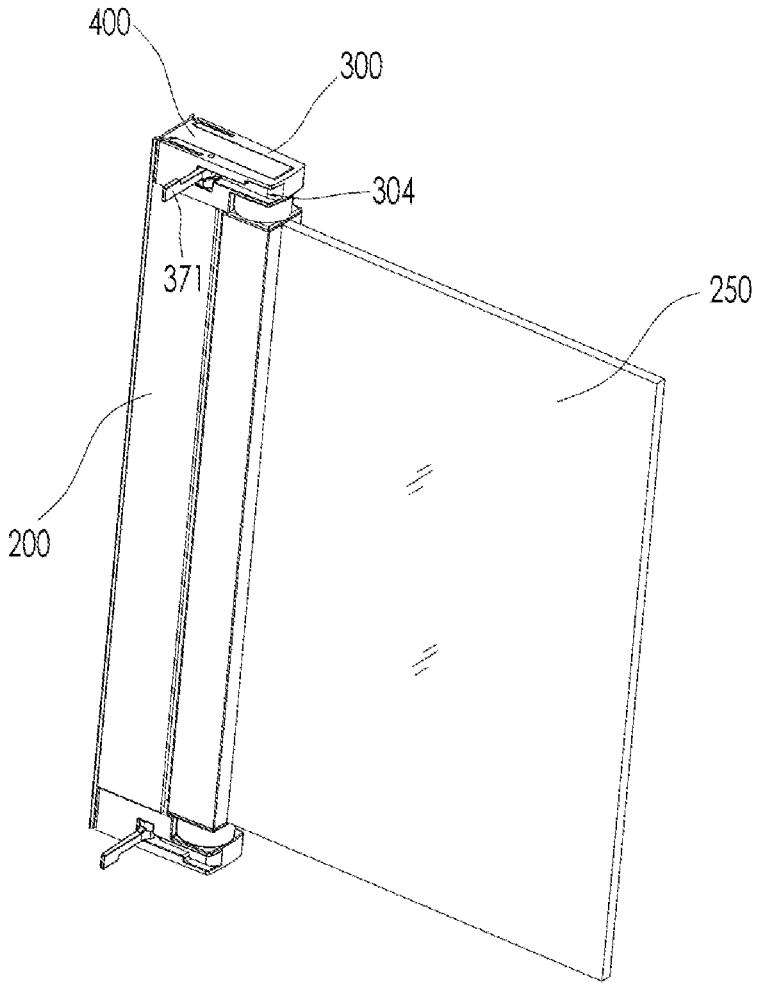
FIG. 10 shows an assembling state of the shower door assembly, wherein the door assembly is unlocked.
Figure 12:
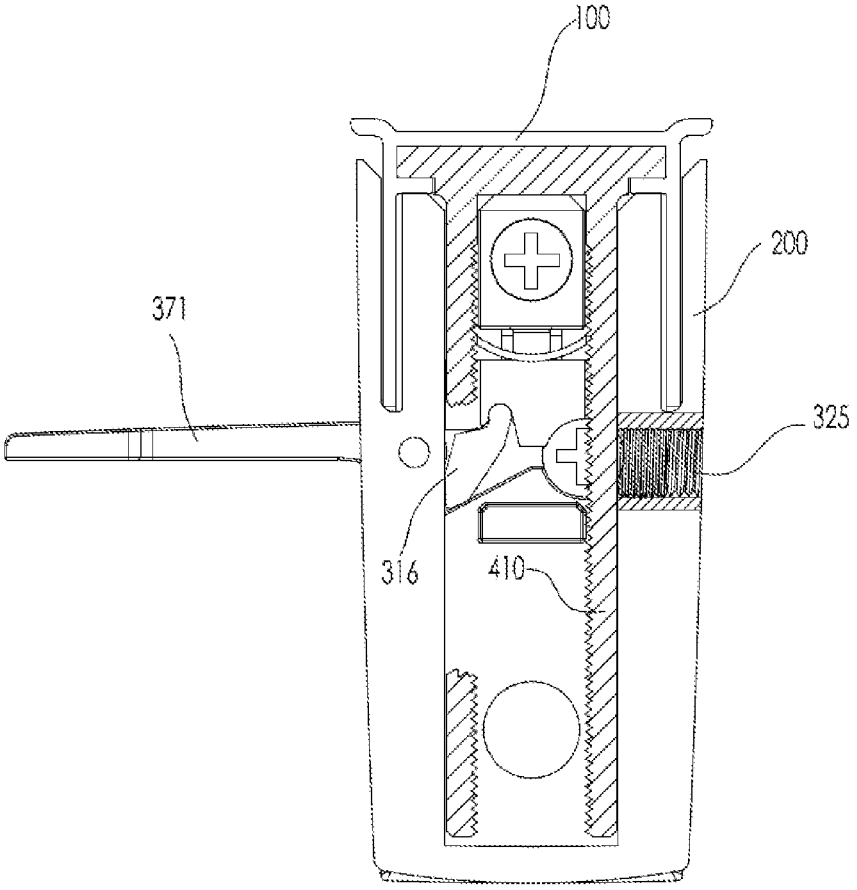
FIG. 12 is a sectional view of the state as shown in FIG. 10.

FIG. 10 shows the shower door assembly in a first state wherein the locking device and the adjustment device are combined, but the movable frame 200 and the stationary frame 100 are not locked. FIG. 12 shows a top view of the shower door assembly in this state. As shown, the cam mechanism 317 is in an open position and the sliding element 316 is not actuated. The elastic element 314 is thus in an uncompressed condition. The movable frame 200 and the stationary frame 100 can freely move with respect to each other.

Figure 11:
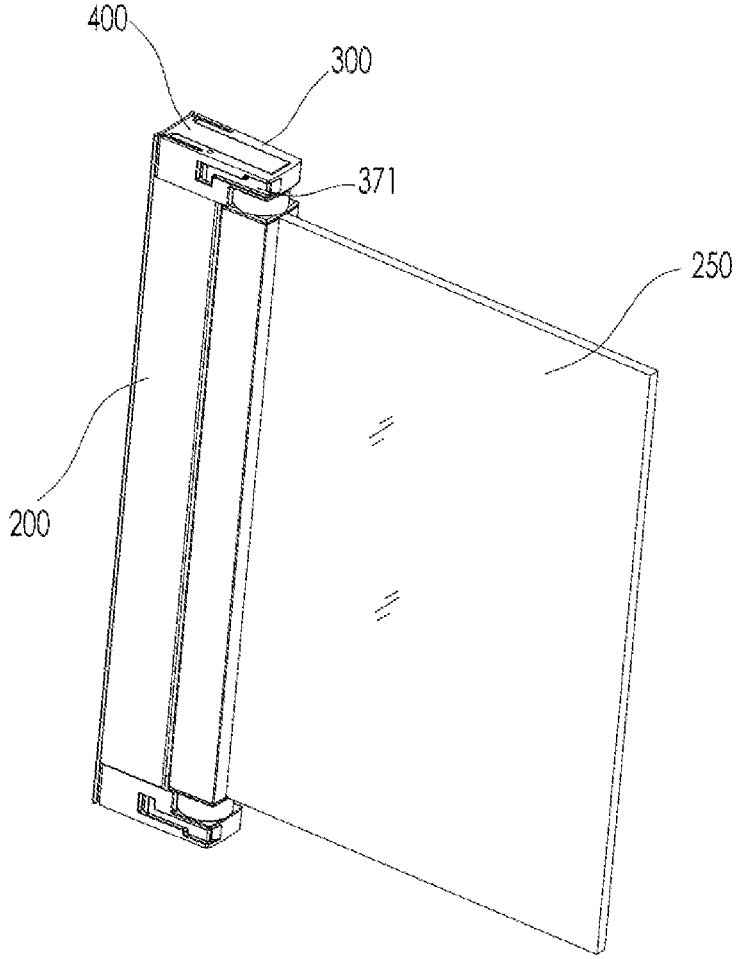
FIG. 11 shows another assembling state of the shower door assembly, wherein the door assembly is locked.
Figure 13:
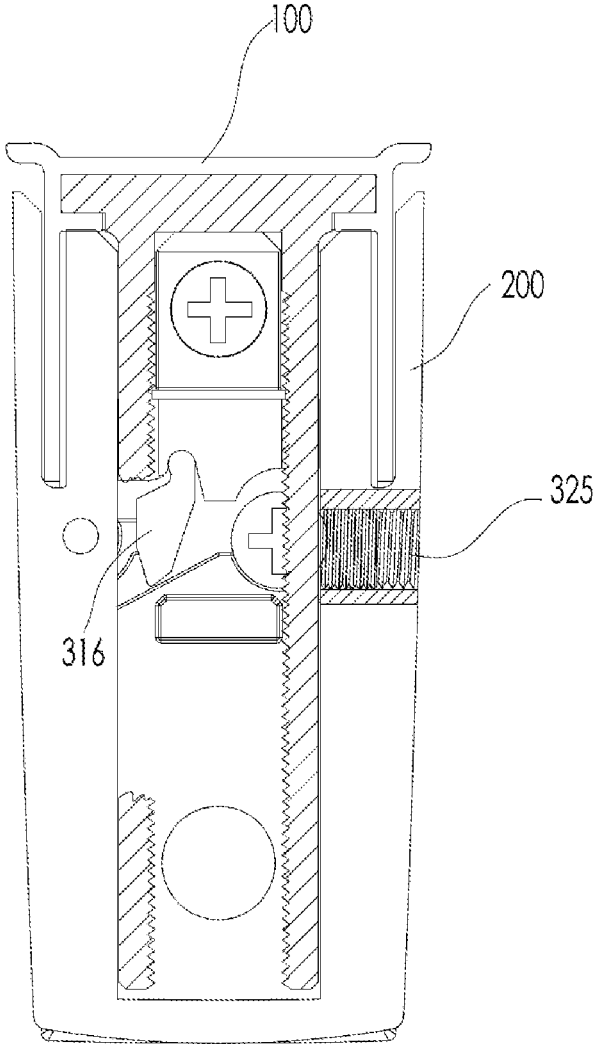
FIG. 13 is a sectional view of the state as shown in FIG. 11.

FIG. 11 shows the shower door assembly in a second state wherein the locking and adjustment devices are locked together, so that the relative position between stationary frame 100 and the movable frame 200 can not be changed. FIG. 13 shows a top view of the shower door assembly in this state. As shown, the cam mechanism 317 is in a close position and received within the receiving groove 304. The sliding element 316 is actuated to slide along the inclined surface 330, so as to push the pressing element 315 to move towards the blocking element 311. The elastic element 314 will then be pressed to gradually become flat. The lateral width of the elastic element 314 increases and eventually engages with the extension 410 of the adjustment device, such that the adjustment device is pressed against the two opposite sides of the locking device and therefore immovable in relation to the movable frame 200. The stationary frame 100 is therefore immovable in relation to the movable frame 200.

Optionally, in this example, the locking device 300 is provided with a threaded hole 305 penetrating through one side of the locking device. When the adjustment device 400 and the locking device 300 is locked, a screw 325 can be screwed into the threaded hole and abutted against the extension 410 so as to enhance the engagement between the flattened elastic element and the extension. On the other hand, in order not to cause unrecoverable deformation to the elastic element, it is preferably that, in the second cavity 320, a spacer element 321 is provided in a space formed by the extension.

It should be understood that various example embodiments have been described with reference to the accompanying drawings in which only some example embodiments are shown. The present invention, however, may be embodied in many alternate forms and should not be construed as limited to only the example embodiments set forth herein.

The invention claimed is:

1. A shower door assembly, comprising: a stationary frame, a movable frame and at least one adjustment assembly disposed between the stationary frame and the movable frame, the at least one adjustment assembly comprising an adjustment device and a locking device, the adjustment device being detachably connected to the stationary frame and having an extension, the locking device being detachably connected to the movable frame, wherein the locking device comprises two opposite sides and a bottom side connecting said two opposite sides, the opposite sides and the bottom side defining a first cavity having a first depth and a second cavity having a second smaller depth, the first and second cavity jointly receiving the extension of the adjustment device;

a blocking element, a pressing element and an elastic element disposed between the blocking element and the pressing element being located in the first cavity, the elastic element being arc-shaped when unlocked, an interface between the first and the second cavity having at least a portion forming an inclined surface projecting to the blocking element; and a driving device comprising a cam mechanism and a sliding element in the first cavity, the sliding element has one end in contact with the pressing element and the other end sliding along with the inclined surface when driven by the cam mechanism so as to push the pressing element toward the blocking element, and thus reduce the curvature of the arc-shaped elastic element until the elastic element is engaged with the adjustment device.

2. The shower door assembly according to claim 1, wherein the arc-shaped elastic element has an intrados facing towards the blocking element.

3. The shower door assembly according to claim 1, wherein the blocking element comprises a guiding rod, and each of the pressing element and the arc-shaped has a through hole, through which the guiding rod can pass so as to guide the movements of the pressing element and the elastic element within the first cavity.

4. The shower door assembly according to claim 1, wherein the pressing element has a guiding groove for receiving the one end of the sliding element, and the guiding groove has a width large enough to maintain the one end within the guiding groove when the sliding element is sliding along the inclined surface.

5. The shower door assembly according to claim 1, wherein the locking device has a threaded hole penetrating through one of the two opposite sides such that screw can be screwed into the threaded hole and abutted against the extension.

6. The shower door assembly according to claim 1, wherein the pressing element has platforms at two sides, for in contact with the two opposite sides of the locking device.

7. The shower door assembly according to claim 1, wherein a surface of the extension of the adjustment device comprises a plurality of teeth including two adjacent teeth, further wherein the arc-shaped elastic element is embedded between the two adjacent teeth.

8. The shower door assembly according to claim 1, wherein the locking device is attached to the movable frame at at least two different linkage points, such that the locking device will not rotate about the movable frame.

9. The shower door assembly according to claim 1, wherein the arc-shaped elastic element is flattened when pressed, whereas the curvature is zero.

10. The shower door assembly according to claim 1, wherein the shower door assembly comprises two adjustment assemblies located at terminal ends of the stationary/movable frames, and the adjustment assemblies are disposed in opposite.

* * * * *